United States Patent [19]

Thomas

[11] 4,252,382

[45] Feb. 24, 1981

[54] DRAWER SLIDE

[75] Inventor: Eberhard Thomas, Gross-Zimmern, Fed. Rep. of Germany

[73] Assignee: Karl Lautenschlager KG, Mobelbeschlagfabrik, Reinheim, Fed. Rep. of Germany

[21] Appl. No.: 98,053

[22] Filed: Nov. 28, 1979

[30] Foreign Application Priority Data

Dec. 2, 1978 [DE] Fed. Rep. of Germany ..... 2852230

[51] Int. Cl.[3] ..... F16C 29/04

[52] U.S. Cl. ..... 308/3.8; 312/341 R

[58] Field of Search ..... 308/3.8, 6 R, 3.6, 3 A, 308/3.9; 312/341, 341 NR, 342

[56] References Cited

U.S. PATENT DOCUMENTS

| | | | |
|---|---|---|---|
| 3,679,275 | 7/1972 | Fall et al. | 312/341 NR |
| 3,901,564 | 8/1975 | Armstrong | 308/3.8 |
| 3,912,341 | 10/1975 | Stein | 308/3.8 |
| 4,194,793 | 3/1980 | Offermans | 312/341 R |

*Primary Examiner*—Lenard A. Footland

[57] ABSTRACT

Drawer slide for drawers and other such drawer-like furniture parts, consisting of preferably two tracks of approximately channel-shaped cross section and different web height, and fastened to opposite sides of the drawer and to the fixed furniture part respectively, stops being provided at the ends of the tracks, which are engaged by a ball cage in the maximum outdrawn position and thereby prevent any unintentional separation of the tracks. The cage has limbs projecting into the interstices between flanges of the tracks, in which openings holding the balls of the ball cage are provided. The web section has a resiliently deformable tongue section projecting, in the maximum outdrawn position, at least partially beyond the end of the track fastened to the fixed furniture part, and having at least one detent projection projecting towards the track fastened to the drawer. A detent aperture is provided in the area of the track provided on the drawer and is situated opposite the detent projection in the maximum outdrawn position. The detent projection can be arrested in the aperture by resilient deformation of the tongue section. A counterstop of the cage is provided in the resiliently deformable area of the tongue section and co-operates with the end stop on the furniture-fast track and is so dimensioned that, when the tongue section is deformed in the position of engagement of the detent projection in the detent aperture it is offset from its stop position so far that it can be over-ridden by the end stop of the furniture-fast track.

16 Claims, 11 Drawing Figures

DRAWER SLIDE

BACKGROUND

Figures 1, 2, 3, 4, 5, 6, 7:
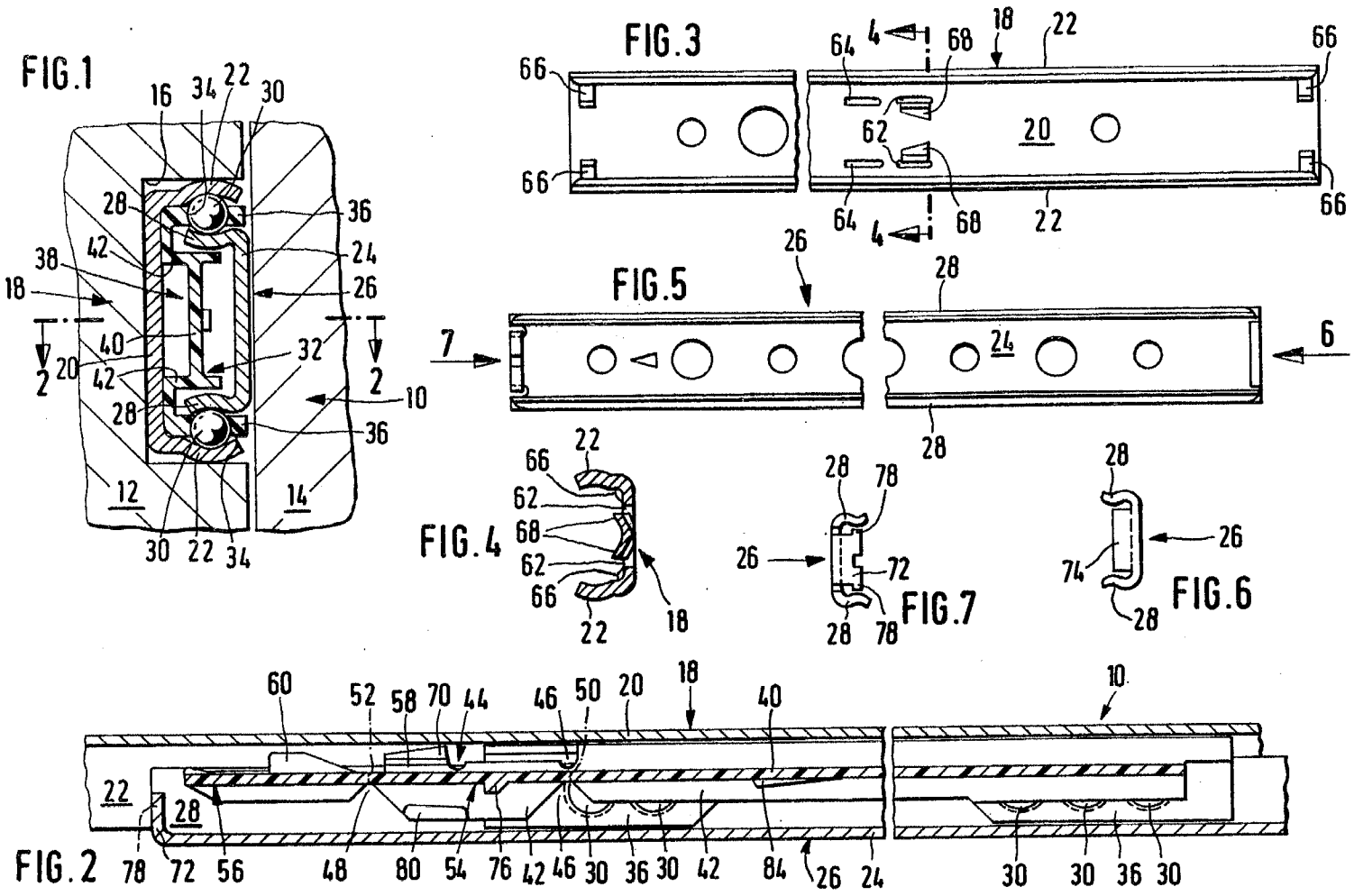

The invention relates to a slide for drawers and other such drawer-like furniture parts, consisting of at least one pair, preferably two pairs of channel-shaped tracks of different width, one track fastened by its web to each side of the drawer and another fastened by the web of the channel to the carcass of the furniture opposite and parallel to the first track, the flanges of the narrower channel being disposed between the flanges of the wider channel, and bearing balls held in a cage are disposed between the outside of the flanges of the narrower channel and the inside of the flanges of the wider channel and rolling in ball races formed in the flanges, and stops are provided at the ends of the tracks to engage the ball cage when the slide is fully extended and thereby prevent any unintentional separation of the tracks from one another.

Such drawer slides are increasingly used in modern furniture, especially for drawers, work boards, appliance carriers and the like, because they are less bulky than roller guides, and because they require little effort to open even when heavily loaded. In the first assembly of furniture provided with such drawer slides, the problem is encountered that, when the track fastened to the drawer is to be attached to the track fastened to the carcass, the ball cage has to be in a certain position. Furthermore, although the drawer must be secured by stops against being pulled too far out, it must nevertheless be possible to remove it completely when desired.

THE INVENTION

It is therefore the object of the invention to create a furniture drawer slide of simple and inexpensive design in which the drawer or the like can be rapidly attached to the ball cage without difficult manipulation, and will be secure after installation against complete withdrawal, while at the same time making it possible to withdraw the drawer completely when desired, and then return it to its place.

Setting out from a drawer slide of the kind mentioned above, this object is achieved in accordance with the invention by the fact that the ball cage has flanges projecting from a web-like portion into the space between the flanges of the channel-like tracks, and the apertures for holding the bearing balls are provided in those ball-cage flanges; that the web-like section of the ball cage has at its front end a resiliently deformable tongue projecting at least partially beyond the end of the track fastened to the furniture carcass and provided with at least one detent projection extending towards the track fastened to the drawer; that in the portion of the drawer-mounted track that is opposite the detent projection when the slide is in the fully extended state a detent aperture is provided in which the detent projection can be engaged by the resilient deformation of the tongue, and that, in the resiliently deformable portion of the tongue there is provided a cage counterstop cooperating with the end stop on the carcass-mounted track, this counterstop being of such size that, upon the deformation of the tongue to the position in which the detent projection is engaged in the detent aperture, the counterstop is offset from its stopping position to such an extent that the end stop of the carcass-related track can pass over it. The cage, therefore, can be fixed in the corresponding track in the position required for the installation of a drawer or the like, namely in the fully extended position, by deforming the tongue against the track pressing the detent projection into the corresponding detent aperture. The cage, therefore, cannot accidentally shift when the drawer is attached, until the catch is released, even in the event of improper procedure. By the disposition of the counterstop on the deformable section of the tongue for cooperating with the track end stop, it is brought about that the stops are put out of engagement precisely when this is necessary, namely when the drawer is being attached to or detached from the cabinet.

In a preferred further development of the invention, at least one projection elongated in the direction of drawer movement is provided in the portion of the resiliently deformable tongue of the ball cage which projects beyond the end of the carcass-mounted track when the slide is in the fully extended position, with which there is associated a projection provided on the end of the carcass-mounted track, the position of the projections being devised such that, when the tongue is in the undeformed state, they pass by one another, but when it is in the deformed, active state, the projection on the track engages the projection on the tongue when the drawer is pushed inwardly from the fully extended position and, as the movement of the drawer continues, exercises a disengaging force on the tongue. The stops cooperating in this manner thus bring about an automatic release of the ball cage when a drawer is pushed in, and then, when the drawer has to be removed again, it is again necessary to pull the drawer to the fully extended position, lock the ball cage by deforming the tongue and at the same time shift the counterstop on the tongue out of the position for engagement with the end stop on the carcass-mounted track, so that the cage can then pass over this end stop and the drawer can be removed.

The web section of the ball cage joining the ball holding sections together is best spaced approximately centrally between the web portions of the tracks at a distance therefrom, since then the tongue, which constitutes a prolongation of the web section, can be bent towards the track affixed to the drawer by an amount corresponding to the spacing.

In an advantageous further development of the invention the tongue can be deformed out of the plane of the cage web section along two flexural axes disposed transversely of the line of movement of the drawer, but otherwise it is substantially stiff, the first flexural axis being provided at the transition between the web and the tongue and the second on the tongue at a distance from its free extremity. Then at least one detent projection is provided not only in the portion lying between the two flexural axes but also in the portion lying between the free end of the tongue and the second flexural axis, these projections projecting towards the web of the track mounted on the drawer, a detent aperture in the web of the track being situated opposite each of these detent projections when the slide is in the fully extended state. The tongue, therefore, is divided into two portions, of which the portion adjoining the web of the ball cage is deflected at an angle to the web portion when the tongue is bent, while the second area is then bent back again at an angle to the first portion, so that the second portion will be in engagement with the web of the tracks while at the same time being virtually parallel to the ball cage web section. The disposition of one or more detent projections in each of the two portions of the tongue has the advantage that the stresses acting on the detent projections can be shared and thus reduced.

The ball cage including the tongue and the detent projections provided thereon can be manufactured advantageously of a resilient plastic, since then it can be made in one piece inexpensively by the injection molding process.

The above-mentioned sharing of the stress on the detent projections can be achieved by providing for the detent projection or projections and the corresponding detent aperture or apertures in the track between the free end of the tongue and the second flexural axis to fit one another in a complementary manner, while the surface of the detent projection lying in the detent aperture and facing the free end of the tongue secures the ball cage against displacement on the track in the drawer closing direction, while the detent projection or projections provided in the portion between the flexural axes have each a projecting, thickened portion which, when engaged in the corresponding detent aperture, catches behind the arris thereof and thus resists the return of the tongue to the plane of the web of the ball cage.

The arrises of the detent aperture which are engaged by the thickened portion of the detent projection are then deformed from the back of the web by approximately the amount of the height of the thickened portion towards the free ends of the channel flanges. The thickened portion then does not project in back of the track, so that the otherwise necessary recess in the drawer for the engaged thickened portion can be eliminated.

At the present time an embodiment of the drawer slide of the invention is preferred in which two detent projections spaced laterally apart from one another are provided in both portions of the tongue.

The balls held in the cage are, in an advantageous further development of the invention, concentrated in groups in the front and rear end portions of the cage, while no balls are provided in the area in between. Without increasing the number of balls and thereby increasing roll resistance, the bearing capacity of the slide is greater than that of a cage having the balls evenly distributed over the length, because the balls are now concentrated in the areas of the cage which are subjected to the greatest stress due to momentary loads when the drawer is extended.

The stops provided on the ends of the carcass-mounted tracks are preferably formed from sections of the web of the track which are bent outwardly at right angles between the flanges of the tracks.

The projections which produce the automatic release of the tongue can then be provided on the terminal bent portions engaging the cage in the fully extended state of the slide, and can be in the form of two projections pointing in opposite directions towards the flanges of the track, associated with two projections extending from lateral web projections on the tongue of the cage.

The ball cage counterstop cooperating with the end stop of the carcass-mounted track when the slide is in the fully extended state is provided in the portion of the tongue lying between the two flexural axes, on the flat side opposite the detent projection.

The tracks are preferably metal channels, although where the stresses are low, they can be made of other materials such as plastics, which can be fiber-reinforced plastics if desired.

If the tracks are made of metal, the stops provided at the ends of the tracks mounted on the drawer are bent out of the web of the channel in the same direction as the flanges thereof. If the tracks are made of plastic, say by extrusion, the stops can be produced by partial hot forming operation.

Figures 8, 9, 10, 11:
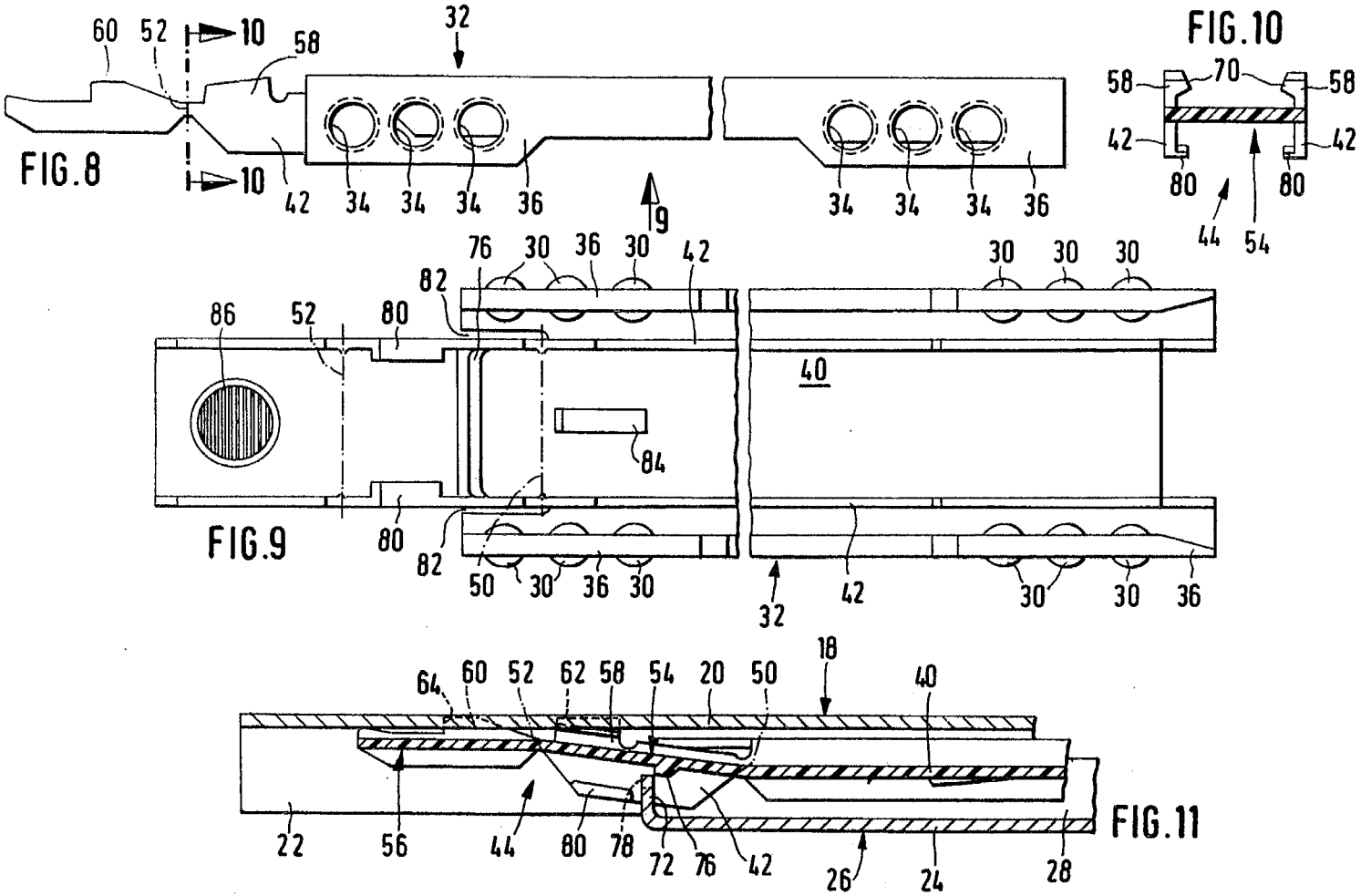

The invention will be further explained in the following description of an embodiment, in conjunction with the drawing wherein:

FIG. 1 is a transverse cross section through a drawer slide of the invention,

FIG. 2 is a longitudinal cross section of the drawer slide of FIG. 1 as seen in the direction of the arrows 2—2 therein, representing the slide in the fully closed state, FIG. 3 is a side elevational view of the channel of the drawer slide of the invention which is to be fastened to the furniture drawer, FIG. 4 is a cross-sectional view taken in the direction of the arrows 4—4 of FIG. 3, FIG. 5 is a side elevational view of the channel of the drawer slide of the invention which is to be fastened to the cabinet carcass, FIG. 6 is a view of the channel fixed to the cabinet carcass, as seen in the direction of the arrow 6 of FIG. 5, FIG. 7 is a view of the channel fixed to the cabinet carcass, as seen in the direction of the arrow 7 of FIG. 5, FIG. 8 is a top view of the ball cage of the drawer slide of the invention, FIG. 9 is a side view of the ball cage as seen in the direction of the arrow 9 of FIG. 8, FIG. 10 is a cross-sectional view taken in the direction of the arrows 10—10 of FIG. 8, and FIG. 11 is a partial cross-sectional view taken in the manner of FIG. 2 through the drawer slide of the invention, the ball cage being shown in the arrested position.

In FIGS. 1 and 2, the drawer slide designated as a whole by the reference number 10 is represented in transverse and longitudinal cross section, respectively, it being assumed that the drawer slide 10 serves for the guidance of the sidewall 12 of a drawer along the supporting wall 14 of a cabinet. On the second drawer sidewall and its related cabinet supporting wall the components of the drawer slide are identical but in a mirror-image relationship to the first.

The drawer slide has a channel-shaped metal track 18 whose web 20 is fastened, by means of screws for example, to the bottom of the groove 16 in the drawer sidewall 12, while the flanges 22 of the channel project from the bottom of the groove toward the supporting wall 14. The web 24 of a second channel-shaped metal track 26, which is narrower than the web 20 of the first track, is fastened to the supporting wall 14, and its flanges 28 projecting therefrom are contained within the flanges 22. In the space between the insides of the flanges 22 and the outsides of the flanges 28 there are disposed steel balls 30. The flanges 22 and 28 of the channels are of curved cross section to correspond to the diameter of the balls 30, and therefore they form ball races disposed longitudinally of the tracks. Since the balls 30 fit closely into the space between the flanges 22 and 28, the tracks 18 and 26 cannot be separated transversely of the direction of drawer movement.

The balls 30 are held in a cage 32 made of a resilient plastic which fixes their spacing relative to one another, but permits them to roll in their races. The balls 30 are held in apertures 34 adapted to their shape in the ball holding flanges 36 of ball cage 32 extending between the track flanges 22 and 28, and are disposed in groups of three balls each, in the front and in the rearward terminal portion of the ball holding flanges 36 of the cage 32. The ball holding flanges 36 are joined together by a web section 38 whose planar central portion 40 is disposed approximately centrally between the webs 20 and 24 of the tracks 18 and 24. Since the central portion 40 cannot be connected directly to the flanges 36 holding the balls 30, on account of the track flanges 28, this connection is provided in the form of lateral flange-like sections 42 projecting upwardly and downwardly from the central portion 40, which simultaneously serve to stiffen the web section 38 and hence also of the entire cage 32.

The length of the ball cage 32 amounts to only a fraction of the length of the tracks 18 and 26, and, when the drawer is in the fully closed position, the cage is situated approximately in the middle between the ends of the tracks.

A portion of the web section 38 adjacent the drawer front is formed such as to have a tongue 44 projecting partially beyond the end of the carcass-mounted track 24 when the drawer slide is in the fully extended state (FIG. 11), and this tongue 44 is made resiliently deformable relative to the web section 38 by appropriate notches 46 and 48 in the reinforcing flange-like sections 42, along two flexural lines 50 and 52, and in particular the flexural line 50 formed by the notches 46 will still be in the area between the two tracks 18 and 26, while the second flexural line 52 is in front of the end of the carcass-mounted track 24. When the slide is in the fully extended state, the tongue section 44 can therefore be deformed by pressure on its surface towards the web portion 20 of the track 18, being therefore forced, in a first portion 54 directly adjoining the web section 38 into a position at an angle to its planar central portion 40, while the adjoining front-end portion 56 is bent back again by engagement with the web 18 to a position approximately parallel to the central portion 40. Since the flange-like sections 42 are largely cut away in this portion 56 on the side facing the web portion 20, portion 56 is almost in contact with the web portion 20.

The tongue 44 is provided on its side facing the web 20 with detent projections 58 and 60, which are formed virtually of remanent portions of the flange-like sections 42, one detent projection 58 being provided in portion 54, and one detent projection 60 being provided laterally in portion 56, and with them are associated, in the fully extended state, detent apertures 62 and 64, respectively, provided in the web 20 which are engaged by the detent projections when the tongue 44 is deformed.

The track 18 which is to be fastened to the drawer is represented separately in FIG. 3, in which the detent apertures 62 and 64 associated with the detent projections 58 and 60 are easily seen in the web 20. It can furthermore be seen in the drawing that end stops 66 are formed from the web 20 at the ends of the track 18 and prevent the escape of the cage 32 of the installed drawer slide. Bores in the web 20 serve for the installation of screws whereby the track 18 can be fastened in the groove 16.

The cross-sectional view taken through the detent apertures 62 in FIG. 4 shows that these detent apertures 62 are not simply openings in the planar web 20, but that the material of the web 20 is bent up slightly at 68 between the flanges 22, along the adjacent edges of the apertures 62, so that the rearward edges of the bent portions extend inwardly from the aperture 60 and therefore can be engaged by thickened portions 70 formed on the detent projections 58 (FIGS. 2 and 10).

The carcass-mounted track 26 is represented separately in FIGS. 5 to 7, in which it can be seen that the stops 72 and 74 provided on the ends of this track are formed by sections of web 24 which are bent inwardly at right angles between the flanges 28. The stop 72 provided at the drawer-front end of track 26 is of such a width that it just projects approximately to the face of the central portion 40 of the web portion 38 of ball cage 32. Since furthermore its height does not occupy all of the space between the flanges 28 of track 26, the cage 32 might be able to move past this stop 72. This, however, is prevented by a counterstop 76 in the form of a projection extending from portion 54 of the tongue section 44 of cage 32 (FIGS. 2 and 9), which, when the slide is in the fully extended state, just meets the bent section forming the end stop 72.

In FIG. 11 it can be seen that, after the tongue section has been deformed for release purposes, the counterstop 76 is offset so far out of the path of stop 72 that the cage can then pass over the stop 72.

The stop 72 furthermore has in the area of its free end two projections 78 extending in opposite directions toward the flanges 28 (FIG. 7), and with each there is associated, in the portion 54 of the tongue, an elongated projection 80 extending inwardly from the side flanges 42. These elongated projections 80 are in such a position that, when the tongue section 44 is not deformed, the projections 78 pass beneath them. But when the tongue section is engaged with the track 18 with the slide in the fully extended state, and the portion 54 then assumes the angular position best seen in FIG. 11, the underside of the projections 80 also form a ramp which is deflected by projections 78 of the stop 72 when the drawer is being closed. If the closing movement is then continued, the projections 78 force projections 80 back to the normal position, by exercising a force on portion 54 of the tongue 44 which first disengages the thickened portion 70 of the detent projections 58 from the detent apertures 62, and then the tongue section again assumes the normal, undeformed position in line with the web section 38 of the cage 32. Then, however, the counterstop 76 again is in a position wherein it strikes against the stop 72 of the carcass-mounted track 27 when the drawer slide is in the fully extended state.

In FIGS. 8 to 10, the ball cage ball 32 is also represented separately for better comprehension. In the side view represented in FIG. 9 it can be seen that the sections 36 of cage 32 holding the balls 30 and the portion 54 of tongue section 44 situated partially between these sections, slots 82 are provided. The ball holding sections 36 thus do not interfere with the resilient deformation of the tongue 44. Furthermore, an elongated, wedge-shaped projection 84 is shown on the planar central section 40 of the web section 38, can be associated with a projection of complementary inclination (not shown) on the web 24 of the carcass-related track 26, for the purpose of holding the drawer closed with a certain amount of force. On account of the easy operation of ball-bearing drawer slides such holding by means of wedge-shaped projections is desirable when several drawers are mounted in a common carcass, because when a drawer is closed after opening, a slight air pressure is developed in the interior of the carcass whereby closed drawers are forced slightly open. This effect is prevented by the wedge-shaped projection 84 in cooperation with a counter-projection on the carcass-related track, in which case the position of the track projection must be made such that its wedge surfaces lie one on the other with a certain closing force when the drawer is in the closed state. The track projection can best consist also of plastic, and is fastened at the required position on web 24 of track 26, for example by snapping it into an opening provided at this point. The round, fluted area 86 represented in FIG. 9 in the left end area 56 of the tongue section 44 marks the surface on which pressure must be exercised in order to snap the detent projections 58 and 60 into their associated detent apertures 62 and 64, respectively.

I claim:

1. A drawer slide for furniture parts, comprising: first and second tracks of approximately channel-shaped cross section, having webs of different height which extend into one another with flanges to be pointed at one another, and fastened to opposite sides of a drawer and to a fixed furniture part respectively, balls held in a cage being disposed between the outside of the flanges of the track of lower web height and the inside of the track of greater web height, the balls rolling in ball races formed in the flanges, stops provided at the ends of the tracks and engaged by the ball cage in the maximum outdrawn position of the drawer to thereby prevent unintentional separation of the tracks, said cage having a web and limbs projecting from said cage web into the interstices between the flanges of the tracks, in which limbs openings holding the balls are provided, said cage web having a resiliently deformable tongue section projecting, in said maximum outdrawn position, at least partially beyond the end of the second track, and having at least one detent projection projecting towards said first track, a detent aperture in the area of said first track, said aperture being situated opposite said detent projection in the maximum outdrawn position, said detent projection being adapted to become arrested in said aperture by resilient deformation of the tongue section, a counterstop of the cage being provided in the resiliently deformable area of the tongue section, and cooperating with the end stop on the second track, and being so dimensioned that, when the tongue section is deformed to the position of engagement of the detent projection in the detent aperture, it is offset from its stop position so far that it can be overridden by the end stop of the second track.

2. A drawer slide according to claim 1, comprising, in the area of the resiliently deformable tongue section of the cage, which projects in the maximum outdrawn position from the second track: at least one projection elongated in the outdrawing direction with which a projection provided at the end of said second track is associated, the position of said two projections being such that in the undeformed state of the tongue section they ride past one another, but in the deformed detent position the track projection strikes against the tongue projection upon pushing in from the maximum outdrawn position, and, with increasing pushing-in movement, exercises on the tongue section a force in the disengaging direction.

3. A drawer slide according to claim 1, wherein said cage web joining the limbs of the ball cage lies at a distance approximately centrally between the webs of the tracks.

4. A drawer slide according to claim 3, wherein said tongue section is constructed for deformation out of the plane of the cage web along two flexural axes disposed at right angles to the outdrawing direction of the drawer, but is otherwise of substantially rigid construction, the first flexural axis being provided at the transition from the cage web to the tongue section, and the second flexural axis being provided at a distance from the free tongue end; both in a first area lying between the two flexural axes and in a second area lying between the free end of the tongue section and the second flexural axis, there being at least one detent projection which projects toward the web of the first track, which in the maximum outdrawn position is opposite one detent aperture each in the web of the first track.

5. A drawer slide according to claim 4, wherein the detent projection or projections provided in the area lying between the free end of the tongue section and the second flexural axis, and the corresponding detent opening or openings in the track, fit complementarily into one another, the surface of the detent projection lying in the detent aperture, which surface faces the free tongue section end, securing the cage against displacement on the first track in the drawer closing direction, while the detent projection or projections provided in the area lying between the flexural axes, have each a projecting head portion which, upon engagement in the corresponding detent aperture, catchingly engages the area surrounding the aperture on the rear side and thereby offers a resistance to any deformation of the tongue section back into the plane of the web of the cage.

6. A drawer slide according to claim 5, wherein the area of the detent aperture which is caught by the head portion of the detent projection is deformed from the back of the web portion by approximately the height of the head portion towards the free ends of the flanges.

7. A drawer slide according to claim 1, wherein said ball cage including the tongue section and the detent projections provided thereon, is made of a resilient plastic.

8. A drawer slide according to any one of claims 4 to 6, wherein in each of the first and second tongue section areas two detent projections are provided at a lateral distance from one another.

9. A drawer slide according to any one of claims 4 to 6, wherein the counterstop of the cage, which cooperates with the end stop of the second track in the maximum outdrawn position, is provided in the area of the tongue section lying between the two flexural axes on the flat side opposite the detent projection.

10. A drawer slide according to claim 1, wherein the balls held in the cage are disposed in group-wise concentration in the forward and rearward end areas only of the limbs.

11. A drawer slide according to claim 1, wherein the stops provided at the ends of the second track are formed by sections of the web of the second track bent at right angles between its flanges.

12. A drawer slide according to claim 11, wherein from the bent end section lying against the cage in the maximum outdrawn position two projections pointing in opposite directions at the flanges of the tracks project, with which two projections of the cage projecting from lateral web projections on the tongue section are associated.

13. A drawer slide according to claim 1, wherein on the flat side of the web section of the cage facing the second track, a projection is provided which, in the fully closed position of the drawer, engages a counter-projection on the second track.

14. A drawer slide according to claim 13, wherein the projection on the cage and the counter-projection on the second tract are elongated, wedge-shaped projections inclined in a complementary manner in the drawer opening direction, the inclined wedge surfaces of the projections coming to rest one on the other in the completely closed position of the drawer.

15. A drawer slide according to claim 1, wherein said tracks are metal channels.

16. A drawer slide according to claim 15, wherein the stops provided on the ends of the first tracks are formed outwardly towards the free ends of the flanges.

* * * * *